United States Patent [19]

Noirjean

[11] Patent Number: 4,884,258

[45] Date of Patent: Nov. 28, 1989

[54] MINIATURE TABLE CLOCK

[75] Inventor: Pierre-André Noirjean, Courfaivre, Switzerland

[73] Assignee: ETA SA Fabriques d'Ebauches, Grenchen, Switzerland

[21] Appl. No.: 347,668

[22] Filed: May 5, 1989

[30] Foreign Application Priority Data

May 10, 1988 [CH] Switzerland ..... 1772/88

[51] Int. Cl.[4] ..... G04B 37/12

[52] U.S. Cl. ..... 368/276; 368/262

[58] Field of Search ..... 368/250, 262–263, 368/276, 316–317

[56] References Cited

U.S. PATENT DOCUMENTS

| | | | |
|---|---|---|---|
| 2,746,237 | 5/1956 | Anderson | 368/317 |
| 3,604,200 | 9/1971 | Sapper | 58/21.15 |
| 4,194,354 | 3/1980 | Terraillon | 368/276 |
| 4,505,597 | 3/1985 | Flinn, Jr. | 368/262 |
| 4,702,614 | 10/1987 | Copley et al. | 368/262 |

FOREIGN PATENT DOCUMENTS

| | | |
|---|---|---|
| 1833188 | 6/1961 | Fed. Rep. of Germany . |
| 2427904 | 2/1976 | Fed. Rep. of Germany . |
| 414172 | 3/1974 | Switzerland . |

*Primary Examiner*—Vit W. Miska

*Attorney, Agent, or Firm*—Griffin, Branigan & Butler

[57] ABSTRACT

A miniature table clock is provided with a case having rounded contours. The back (16) of such case exhibits a protruding zone and a flattened surface proximate said zone at the mid portion of its lower half. The clock has two positions of stable equilibrium; a first in which the dial (18) is parallel to the clock support plane and facing thereto and a second in which the clock, appropriately ballasted, rests at a point of the protruding zone adjacent the flattened surface.

5 Claims, 1 Drawing Sheet

MINIATURE TABLE CLOCK

This invention concerns miniature table clocks of the type in which the case exhibits rounded forms and is arranged so as to be able to occupy two positions of stable equilibrium, a first in which the dial is hidden and a second in which the dial is visible, the clock then being supported on the back cover of the case.

BACKGROUND OF THE INVENTION

A miniature clock of this type is described in the German Utility Model 1.833.188. The case of this clock includes a front glass and a back cover in the form of a hemispheric cap, provided with a flat portion forming a support surface and which defines a first position of stable equilibrium. This clock further includes a ballast mass proximate said surface.

It is likewise possible to have the clock rest in a second position of stable equilibrium supported on its glass. These two positions are defined by planar surfaces. The clock thus obtained shows great stability. Thus, to unbalance it it is necessary to apply a force such that the resultant defined by this force and the weight of the clock is located on a straight line coming out of the support surface.

A purpose of this invention is on the contrary to provide a clock readily movable about its second equilibrium position.

Furthermore, in view of its hemispherical form, the clock as described hereinabove exhibits a squat and heavy aspect.

A further purpose of this invention is to provide an article having a lighter form.

SUMMARY OF THE INVENTION

These purposes are attained in a miniature table clock including a case provided with a front glass and a back cover in the form of a cap, an arrangement for displaying the time of day covered by the glass and positioning means defining two positions of stable equilibrium, a first position in which the case rests on its front face and a second position in which the case rests on the back cover, said back cover including a first zone defined by a first convex surface a portion of which serves to bear the clock in its second equilibrium position and a second zone defined by a second convex surface surrounding the first zone, the mean radius of curvature of the first surface being less than the mean radius of curvature of the second surface.

An embodiment of the miniature clock in accordance with the invention is schematically shown by way of example in the annexed drawings.

DESCRIPTION OF THE PREFERRED EMBODIMENT

Figure 1:
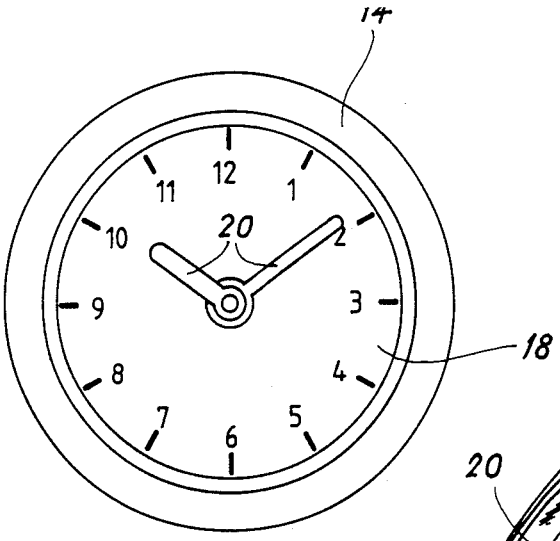
FIG. 1 is an elevational view looking at the dial.

The miniature clock as shown includes a case 10 with a glass 12, a bezel 14 and back cover 16. At the interior of the case are to be found display means including a dial 18 and hands 20 as well as a movement driving the hands 20. This movement is energized by a battery 22. It includes an alarm function controlled by a gravitational switch schematically shown at 24.

Glass 12, slightly convex, is fixed to the bezel 14. Both of these are of circular form. The outer contour of the profile of the bezel 14 is approximately in the form of a quarter of a circle. The edge of such bezel 14 abuts against the edge of the back cover 16. This latter is in the form of a cap, that is to say exhibits a curved and convex surface. The form of this back cover will be defined more precisely hereinafter. The case 10 thus defined has thus rounded forms which give it an agreeable aspect as much in its appearance as in its feel.

A cross-section perpendicular to the dial via the axis 12 o 'clock to 6 o 'clock corresponds to the profile view of FIG. 2, the back cover 16 exhibiting a first arc of circle 26, the center 01 of which is in front of the dial 18 below the axis passing through its center. This arc 26 is connected to the edge of the back cover 16 by a second arc of a circle 28 of small radius centered to the right of the edge of the back cover 16 in order to assure matching with the bezel 14.

In view of the position of the center 01 it is apparent that the upper half of the back cover 16 of the case 10 is thinner than the lower half. The difference in thickness between these two portions of the back cover 16 contributes to the elegance of the clock in a substantial measure.

Figure 2:
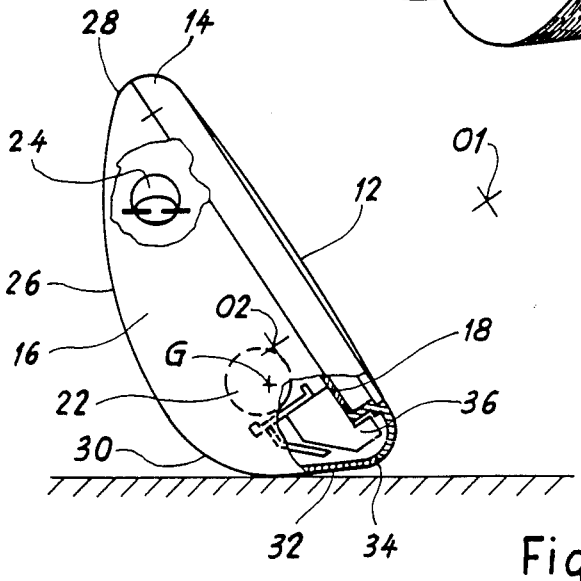
FIG. 2 is a profile view with cut away portions.

FIG. 2 shows that the other end of arc 26 matches with a third arc of a circle 30 of smaller radius. The center 02 of arc 30 is located within the back cover 16. This arc 30 forms part of a protruding zone of the back cover 16 which will be described in detail hereinafter. The other extremity of arc 30 matches with a rectilinear segment 32, itself matching with the edge of the back cover 16 by means of an arc of a circle 34 corresponding to arc 28. By matching between these arcs and the described segment it must here be understood that one passes from one of these elements to the neighbouring element with a common tangent, i.e. without a sharp edge.

In other terms, the back cover 16 takes the form of a cap made up of a juxtaposition of portions of ellipsoids, cone and torus, these portions together defining a continuously curved surface. From this it results that neighbouring portions are substantially tangent to one another.

More precisely, the zone neighbouring segment 32 is defined by a portion of a cone generated by the segment 32 turning about the axis of the hands. The edge of the back cover 16 shown on FIG. 2 by arcs 28 and 34 assumes the form of a section of a torus of which the generating axis is common with that of the hands. The other portions of the back cover 16 are defined by a warped surface which may be broken down into a plurality of ellipsoidal portions. All of the portions are arranged in a manner so that they are substantially tangent to one another.

Furthermore, the protruding zone of which arc 30 forms a portion is defined by a part of a sphere the radius of which is subtantially less than the average radius of the neighbouring zone. The dimensional relationship between these radii is typically equal to $\frac{1}{3}$.

Thus, the back cover 16 of case 10 is formed by a continuous surface without sharp edges. It exhibits in the center portion of its width and in the lower half a first zone defined by a first convex surface on which the clock is supported in its second equilibrium position and a second zone defined by a second convex surface and surrounding the first zone. The average radius of curvature of the first surface is less than the average radius of curvature of the second surface. Furthermore, the second surface includes, in the portion taken between the first zone and the lower edge of the case, a flattened surface defined by the conical portion and proximate a protruding zone In all the sections under consideration, the profile of the back cover 16 of the case is naturally closer to the dial 18 than in the section passing through the axis 12 o'clock -6 o'clock of this latter. It follows that the surface of the back cover 16 is entirely situated at the interior of a semi-spherical surface centered in the plane of the edge of the back cover 16 at the intersection with the axis of the hands and having a diameter equal to that of the edge of the back cover, i.e. equal to the diameter of the case itself. The back cover 16 thus has a relatively flat form which gives it its elegance.

A first position of stable equilibrium of the clock as described is that in which the glass 12 or bezel 14 rests on a flat support (work table, desk, night table, etc.). In this position dial 18 is evidently hidden.

Figure 3:
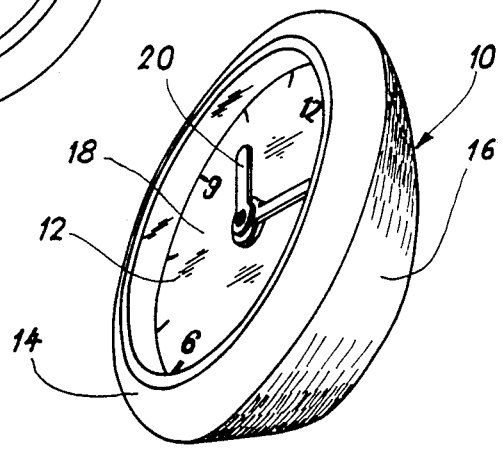
FIG. 3 is a perspective view.

In the second position of stable equilibrium shown on FIG. 3, dial 18 is inclined. It is located approximately in a plane perpendicular to the axis of vision of a person seated at the table on which the clock may rest.

To assure the stability of this second equilibrium position, the clock is provided with a counterweight 36 housed in the lower portion of case 10, more precisely at the front and above the portion of case 10 including the flattened surface and engaged in the bezel 14, this latter being hollowed out.

Counterweight 36 thus forms ballast for the clock. This ballast is completed by the battery 22 which is the heaviest component of the clock and which is placed behind the dial and just above the counterweight 36. This latter and battery 22 ballast the clock in a manner such that its center of gravity G is located below point 02. More precisely, the mass and position of the counterweight 36 are chosen in a manner such that the straight line passing through points 02 and G makes an angle of approximately 30° with a surface tangent to the glass.

This angle defines the inclination of the dial in the second equilibrium position of the clock.

Furthermore, the distance between point 02 and point G determines the frequency at which the clock will oscillate when one displaces it from its second point of equilibrium. The frequency is higher in proportion to the increase in this distance.

One may further note that the straight line passing through points 02 and G cut the arc 30 at its end neighbouring segment 32. From this it is evident that the support point of the clock in its second position of stable equilibrium is located in the neighbourhood of the periphery of the protruding zone close to its lower portion. It is thus close to the flattened surface proximate the protruding zone.

Regardless of the point on the back cover 16 of case 10 on which the clock is posed on its plane support, it will tilt until it arrives in its second position of stable equilibrium as described. If the clock should be accidentally pushed from this position of equilibrium, it will thus return thereto.

On the other hand, if, from this second equilibrium position, one exerts pressure from back to front on the clock in the direction of the first position of stable equilibrium, it will be soon supported on the flattened surface of the back cover 16 of its case 10, then will rock immediately pivoted on arc 34. From this instant the center of gravity G of the clock is raised up substantially. A large resistance will thus operate against displacement in the direction as considered and this resistance increases with the amplitude of the displacement. It is only from the instant when the center of gravity passes beyond the vertical from the instantaneous support point of the clock that the latter tends to follow its displacement in the direction of the first position of stable equilibrium.

In view of the conditions as described attending this latter displacement, an accidental push causing the clock to pass from its second stable equilibrium position to its first is most improbable.

A zone of very slightly convex form in place of the flattened surface as described would have a similar effect.

A clock of this type has been constructed. Here by way of example are to be found its basic characteristics.

The edge of the back cover defines a circle of 70 mm diameter. The total thickness of the clock is equal to 30 mm. Arcs 28 and 34 of the edge of the back cover and the arcs of the bezel have a radius of 6 mm. The radius of arc 30 associated with the protruding portion is equal to 20 mm. The center 02 is located 11 mm below the axis of the hands and 10 mm behind the front surface of the clock. Finally, the radius of arc 26 is equal to 59.44 mm while center 01 is located 11 mm below the axis of the hands and at 29.44 mm from the front surface of the clock.

The back cover 16 and bezel 14 are formed by injecting a plastic material known under the name of ABS (acryl butadiene styrene). The counterweight 36 is of lead. It has a mass of 37 grams. Furthermore, the period of oscillation of the clock about its second equilibrium position is on the order of one second.

The clock as described is particularly interesting when it is provided with an audible alarm arrangement which may be manually adjusted and stops automatically in the first position of stable equilibrium, thereby to be usable for alarm.

To this effect, switch 24 is arranged so as to be turned off when the clock occupies the first equilibrium position and turned on when the clock is in its second equilibrium position.

Such switch 24 may advantageously be of the mercury type.

When the alarm is set off, the sleeper still half-conscious who extends his arm to shut off the noise or in order to remove the source or operate an imaginary stop button, will not cause the clock to rock into its first position of stable equilibrium. The alarm will thus not stop. It will continue to manifest itself until the sleeper finally woken up and perfectly conscious, deliberately picks up the clock and places the bezel on the night table.

In this arrangement, the clock constitutes an alarm clock which even a hardened sleeper cannot stop unconsciously and thus pursue his sleep.

The clock as described hereinabove is provided with a back cover 16 which has a continuous curved surface.

In a variant (not shown), it will be possible to provide facets on th back cover in a manner such that the clock would be given a jerky motion when, removed from its second equilibrium position, it returns thereto. Such facets must be very small. Furthermore, it is necessary that the envelope of the back cover thus defined exhibits in the zone neighbouring the point of contact in the second equilibrium position an average radius of curvature less than the radius of curvature of the portion of the back cover surrounding this zone. In order for such solution to be pleasing, it is desirable that the sagitta between the envelope and the facets be constant. In this manner the surface of the facets becomes smaller as the radius of curvature becomes smaller.

In the clock as described and shown, the glass, bezel, back cover and dial have a circular form. It is also possible to obtain these pieces in elliptic or oval forms in respecting nevertheless the conditions as defined hereinabove in order to assure the mobility of the clock about its second equilibrium position.

What I claim is:

1. A miniature table clock including a case provided with a front glass and a back cover in the form of a cap, an arrangement for displaying the time of day covered by the glass and positioning means defining two positions of stable equilibrium, a first position in which the case rests on its front face and a second position in which the case rests on the back cover, said back cover including a first zone defined by a first convex surface a portion of which serves to bear the clock in its second equilibrium position and a second zone defined by a second convex surface surrounding the first zone, the mean radius of curvature of the first surface being less than the mean radius of curvature of the second surface.

2. A miniature table clock as set forth in claim 1 wherein said convex surfaces form a contiuously curved surface.

3. A miniature table clock as set forth in claim 1 or in claim 2 in which a straight line passing through the center of curvature of the first zone and through the center of gravity (G) of the clock forms an angle of about 30° with a surface tangent to the glass.

4. A miniature table clock as set forth in claim 1 wherein the portion of the second zone included between the first zone and the lower edge of the back cover is formed as a portion of a cone.

5. A miniature table clock as set forth in claim 1 including a manually adjustable audible alarm arrangement and a position detecting means arranged so as to interrupt the alarm when the clock is in its first equilibrium position.

* * * * *